US006686925B1

(12) United States Patent
Cappels

(10) Patent No.: US 6,686,925 B1
(45) Date of Patent: Feb. 3, 2004

(54) SYSTEM AND METHOD FOR GENERATING HIGH-LUMINANCE WINDOWS ON A COMPUTER DISPLAY DEVICE

(75) Inventor: Richard D. Cappels, San Jose, CA (US)

(73) Assignee: Apple Computer, Inc., Cupertino, CA (US)

( * ) Notice: Subject to any disclaimer, the term of this patent is extended or adjusted under 35 U.S.C. 154(b) by 107 days.

(21) Appl. No.: 09/705,140

(22) Filed: Nov. 1, 2000

Related U.S. Application Data

(63) Continuation of application No. 08/900,964, filed on Jul. 25, 1997.

(51) Int. Cl.[7] ..... G09G 5/00

(52) U.S. Cl. ..... 345/620; 345/204; 345/211; 348/565; 348/596

(58) Field of Search ..... 345/620, 204, 345/211, 212, 690; 348/596, 380, 511, 528, 564, 565

(56) References Cited

U.S. PATENT DOCUMENTS

| | | | |
|---|---|---|---|
| 4,709,267 | A | 11/1987 | Sendelweck |
| 4,733,229 | A | 3/1988 | Whitehead |
| 4,876,663 | A | 10/1989 | McCord |
| 4,907,174 | A | 3/1990 | Priem |
| RE33,973 | E | 6/1992 | Kriz et al. |
| 5,150,107 | A | 9/1992 | Kurisu |
| 5,204,748 | A | 4/1993 | Lagoni |
| 5,313,291 | A | 5/1994 | Appel et al. |
| 5,386,247 | A | 1/1995 | Shafer et al. |
| 5,394,067 | A | 2/1995 | Santelmann, Jr. |
| 5,396,151 | A | 3/1995 | Cappels, Sr. |
| 5,469,540 | A | 11/1995 | Powers, III et al. |
| 5,473,371 | A | 12/1995 | Choi |
| 5,493,317 | A | 2/1996 | Kim |
| 5,497,436 | A | 3/1996 | Miller |
| 5,512,961 | A | 4/1996 | Cappels, Sr. |
| 5,550,443 | A | 8/1996 | Lee |
| 5,550,556 | A | 8/1996 | Wu et al. |
| 5,555,026 | A | 9/1996 | Lee |
| 5,561,459 | A | 10/1996 | Stokes et al. |
| 5,564,002 | A | 10/1996 | Brown |

(List continued on next page.)

FOREIGN PATENT DOCUMENTS

| | | |
|---|---|---|
| EP | 0856829 | 8/1998 |
| WO | WO 96/17338 | 6/1996 |
| WO | WO 98/32277 | 7/1998 |
| WO | WO 00/17842 | 3/2000 |

OTHER PUBLICATIONS

U.S. patent application Ser. No. 08/900,964, Cappels, Sr., System and Method for Generating High–Luminance Windows on a Computer Display Device, filed Jul. 25, 1997.
U.S. patent application Ser. No. 09/009,042, Cappels, System and Method for Measuring the Color Output of a Computer Monitor, filed Jan. 20, 1998.
U.S. patent application Ser. No. 09/076,664, Krah, System and Method for Dynamic Correction of Display Characteristics, filed May 12, 1998.
U.S. patent application Ser. No. 09/160,503, Cappels, Sr., Apparatus and Method for Handling Special Windows in a Display, Sep. 24, 1998.

*Primary Examiner*—Bipin Shalwala
*Assistant Examiner*—Jimmy H Nguyen
(74) *Attorney, Agent, or Firm*—Nancy R. Simon; Simon & Koerner LLP

(57) ABSTRACT

A system and method for generating high-luminance windows on a computer display device includes a video amplifier which provides video signals to a cathode ray tube, a window generator which provides a window signal to the video amplifier to generate the high-luminance window, and an automatic beam limiter which controls the beam current provided to the cathode ray tube during period of the high-luminance window.

1 Claim, 8 Drawing Sheets

U.S. PATENT DOCUMENTS 5,570,108 A 10/1996 McLaughlin et al.
5,574,507 A 11/1996 Baek
5,579,029 A 11/1996 Arai et al.
5,588,098 A 12/1996 Chen et al.
5,606,348 A 2/1997 Chiu
5,638,117 A 6/1997 Engeldrum et al.
5,675,391 A 10/1997 Yamaguchi et al.
5,694,227 A 12/1997 Starkweather
5,696,528 A * 12/1997 Yun ..... 345/420
5,706,035 A 1/1998 Tsunoda et al.
5,724,519 A 3/1998 Kato et al.
5,726,672 A 3/1998 Hernandez et al.
5,731,843 A 3/1998 Cappels, Sr.
5,742,354 A 4/1998 Vlahos et al.
5,745,097 A 4/1998 Cappels
5,786,803 A 7/1998 Hernandez et al.
5,821,917 A 10/1998 Cappels
5,889,500 A 3/1999 Chuang et al.
5,903,267 A 5/1999 Fisher
5,917,488 A 6/1999 Anderson et al.
5,926,174 A 7/1999 Shibamiya et al.
5,959,691 A 9/1999 Koh
5,966,124 A 10/1999 Devine
5,977,946 A 11/1999 Mizobata
5,978,745 A 11/1999 Devine
5,990,858 A 11/1999 Ozolins
6,026,409 A 2/2000 Blumenthal

* cited by examiner-

SYSTEM AND METHOD FOR GENERATING HIGH-LUMINANCE WINDOWS ON A COMPUTER DISPLAY DEVICE

CROSS-REFERENCE TO RELATED APPLICATIONS

This is a continuation of U.S. patent application Ser. No. 08/900,964, entitled SYSTEM AND METHOD FOR GENERATING HIGH-LUMINANCE WINDOWS ON A COMPUTER DISPLAY DEVICE, filed Jul. 25, 1997.

BACKGROUND OF THE INVENTION

1. Field of the Invention

This invention relates generally to computer displays and more particularly to a system and method for generating high-luminance windows on a computer display device.

2. Description of the Background Art

Optimal and effective presentation of visual information is a significant consideration of manufacturers, designers and users of computer display monitors. The use of computer displays for conveying various types of visual information is also becoming more important as computer system functionality increases. For example, a computer application may advantageously insert a separate viewing area or window onto a computer display screen. The window area may then display selected viewing information that is different from the viewing information presented on the display screen outside the window area. One such implementation displays video information from a video source (such as a video tape recorder) in the window area and simultaneously displays computer generated information (such as text or graphics) on the display screen outside the window area.

Referring now to FIG. 1, a diagram of a display 110 is shown. The display 110 includes a screen 112 that displays various types of viewing information to a system user. Display 110 includes a viewing window 114 which may be selectively sized and positioned on screen 112. A host computer system (not shown) may then advantageously insert selected video images within the video window 114 for viewing while the neighboring text and/or graphic information is simultaneously displayed on the remaining areas of screen 112.

In conventional computer displays that are not specifically designed for displaying video information, luminance levels are typically somewhat lower than the luminance levels used in conventional video displays. These lower luminance levels result in a relatively lower contrast ratio between dark and light areas of displayed information. In practice, window 114 is typically displayed at the same relative luminance levels as much of the surrounding screen 112 on display 110. However, lower luminance levels tend to produce video pictures which appear somewhat drab and washed-out. Conversely, higher luminance levels tend to bring out more detail in the displayed information and thus cause moving video images to appear more vivid and interesting to the viewer.

In operation, luminance levels are proportional to the amount of beam current generated in display 110. Higher luminance levels typically require greater beam current values. These increased beam currents, however, adversely affect the resolution of displayed information by increasing the spot size of the electron beam as it strikes phosphors lining the inner surface of screen 112. The increased spot size may result in a blurring of text or graphic information displayed on screen 112. Increasing beam current also may cause the cathode ray tube (CRT) of display 110 to unacceptably age at a faster degradation rate. Finally, the production of a higher beam current requires display 110 to dissipate a greater amount of power and therefore necessitates a heavier and more costly chassis when manufacturing display 110.

The foregoing factors (which are caused by increasing the luminance levels over the entire surface of screen 112) are undesirable in the design and manufacture of computer display monitors. Therefore, an improved system and method for generating high-luminance windows on a computer display device is needed, in accordance with the present invention.

SUMMARY OF THE INVENTION

In accordance with the present invention, a system and method are disclosed for generating high-luminance windows on a computer display device. In the preferred embodiment of the present invention, the computer display includes a video amplifier, a window generator, a high-voltage power supply (HVPS), an automatic beam limiter (ABL) and a cathode-ray tube (CRT). In the preferred embodiment, the video amplifier receives a video signal which includes information for presentation on the computer display. The video amplifier responsively amplifies the received video signal and then applies the amplified video signal to the cathode of the CRT. The HVPS provides a high-voltage signal to the anode of the CRT. The CRT responsively generates an electron beam which strikes phosphors located on the inner surface of the viewing screen of the CRT.

In the preferred embodiment, a processor device typically provides window control signals to the window generator in the computer display in response to a video application program running on a host computer system. The window control signals advantageously gate the generation of high-luminance windows on the computer display, in accordance with the present invention.

The window generator receives the window control signals and responsively generates and provides a window pulse to the ABL. The generated window pulse provides information about the size and position of the high-luminance windows on the viewing screen of the CRT. The ABL receives the window pulse and responsively generates and provides an analog window signal to the gain control of the video amplifier. The analog window signal thus increases the luminance of the amplified video signal during the period of the high-luminance window by increasing the gain of the video amplifier during the appropriate time period.

To prolong the life span of the computer display, the ABL also advantageously limits the average beam current provided to the CRT during the period of high-luminance window. In practice, the ABL samples beam current supplied by the HVPS. If the sampled beam current from the HVPS exceeds a preset threshold value, then the gain of the video amplifier is limited by adjusting the analog window signal. The present invention thus provides a video window with a higher luminance level than the remainder of the information displayed on the screen of the computer display and is therefore able to advantageously generate high-luminance windows on the computer display device.

BRIEF DESCRIPTION OF THE DRAWINGS

FIG. 4(*b*) is a drawing of a video waveform illustrating relative video levels including a window area in accordance with the present invention;

DETAILED DESCRIPTION OF THE PREFERRED EMBODIMENT

The present invention relates to an improvement in display a devices, including computer displays. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown but is to be accorded the widest scope consistent with the principles and features described herein.

The present invention comprises a system and method for generating high-luminance windows on a computer display device and includes a video amplifier which provides video signals to a cathode ray tube, a window generator which provides a window signal to the video amplifier to generate the high-luminance window and an automatic beam limiter which controls the beam current provided to the cathode ray tube, in accordance with the present invention.

Figure 1:
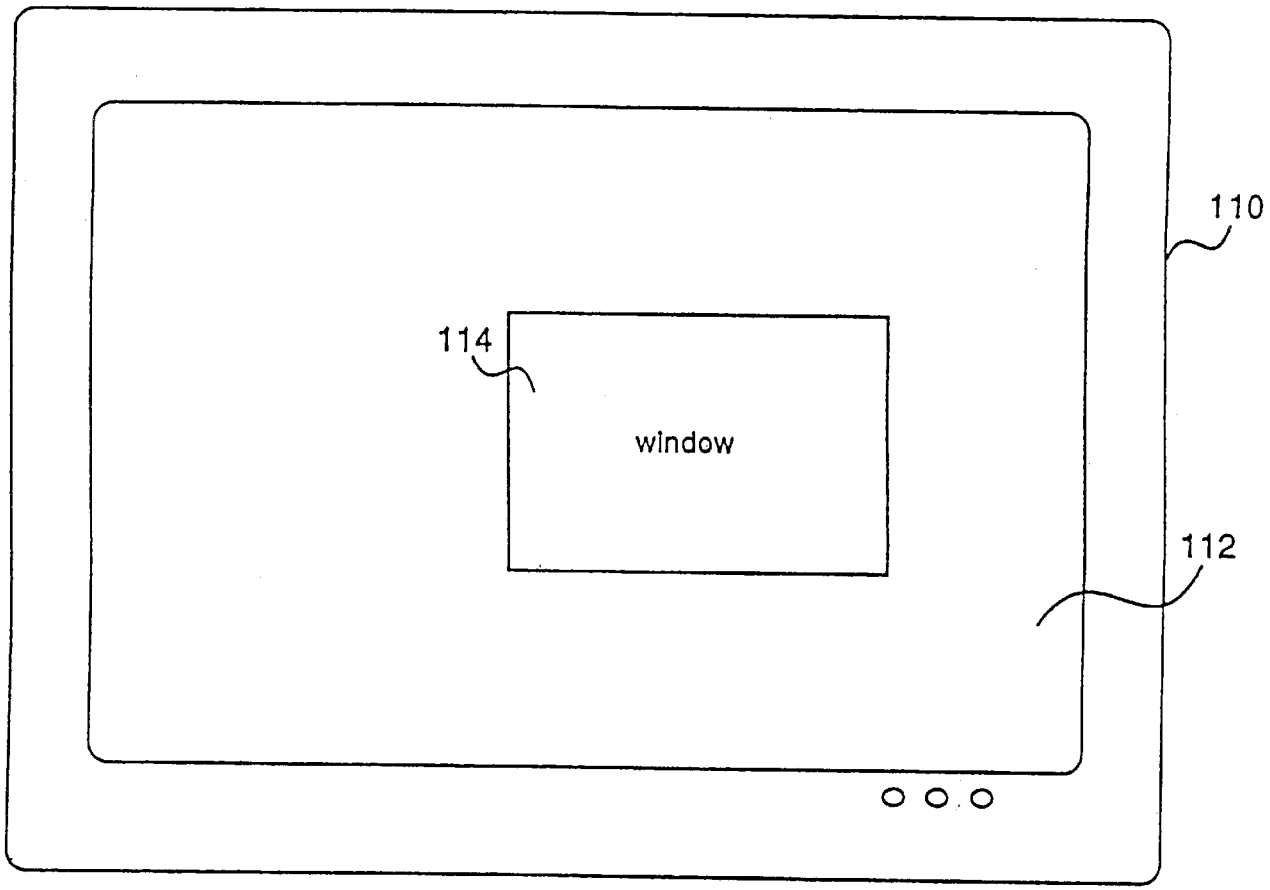
Fig. 1 Prior Art
FIG. 1 is a diagram of a computer display having a window area positioned on the viewing screen of the computer display.
Figure 2:
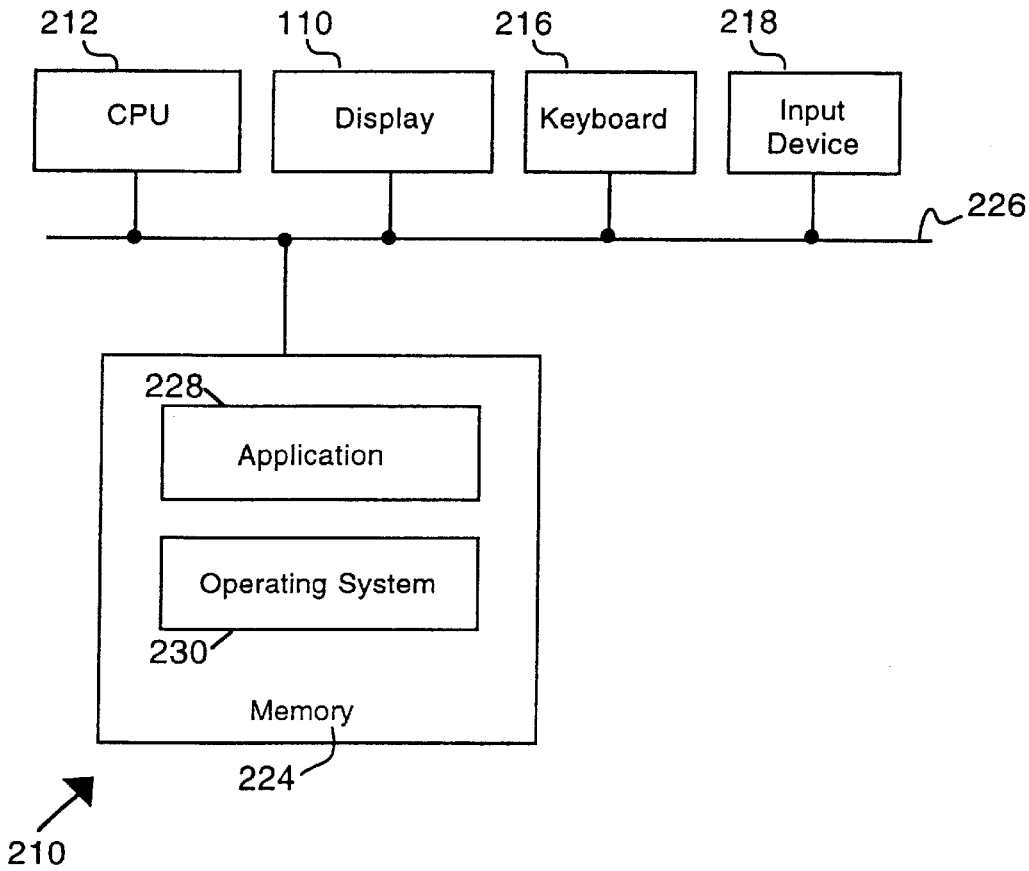
FIG. 2 is a block diagram of a preferred computer system including a computer display.

Referring now to FIG. 2, a block diagram of a computer 210 is shown, in accordance with the present invention. Computer 210 preferably comprises a central processing unit (CPU) 212, a video display 110, a keyboard 216, an input device 218 and a memory 224. Each element of computer 210 is preferably coupled to a common system bus 226. Memory 224 may alternatively comprise various storage-device configurations, including Random-Access-Memory (RAM), Read-Only-Memory (ROM) and non-volatile storage devices such as floppy disks. In the preferred embodiment, memory 224 includes at least one application 228 and an operating system 230.

Figure 3:
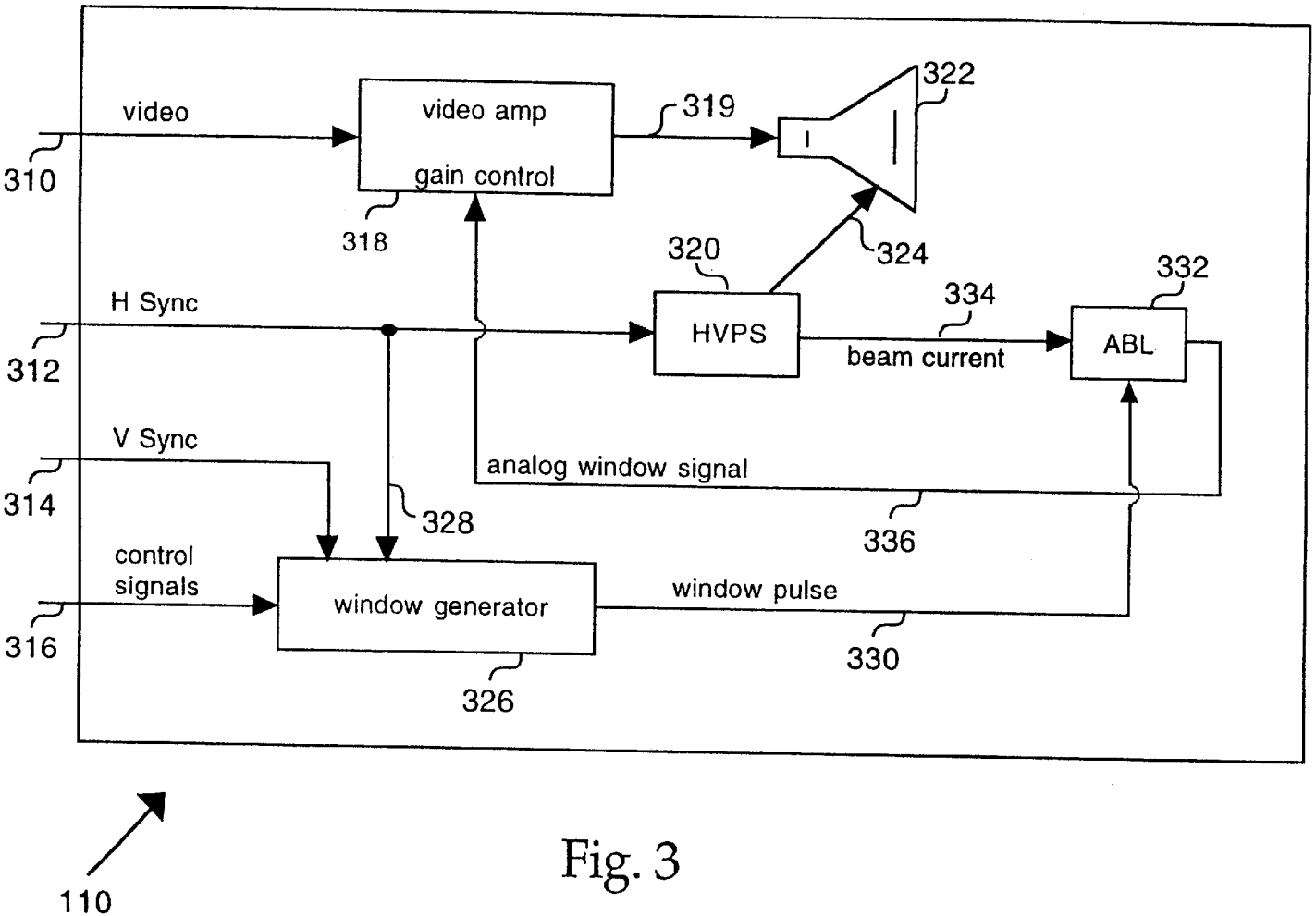
FIG. 3 is a block diagram of the display of FIG. 2, according to the present invention.

Referring now to FIG. 3, a block diagram of the preferred embodiment for display 110 (FIG. 2) is shown, according to the present invention. Display 110 preferably includes a video amplifier 318, a window generator 326, a high-voltage power supply (HVPS) 320, an automatic beam limiter (ABL) 332 and a cathode-ray tube (CRT) 322.

In the preferred embodiment of the present invention, video amplifier 318 receives a video signal via line 310. The video signal includes information for presentation on display 110 and is typically provided by CPU 212 via system bus 226. Video amplifier 318 responsively amplifies the received video signal and then applies the amplified video signal to the cathode of CRT 322 via line 319. HVPS 320 provides a high-voltage signal to the anode of CRT 322 via line 324. CRT 322 responsively generates and provides an electron beam which strikes phosphors located on the inner surface of the viewing screen in CRT 322. In practice, video amplifier 318 includes three separate color channels (red, blue and green) which generate three separate electron beams in CRT 322, however, for simplicity, the following discussion will reference a single electron beam and corresponding beam current.

In the preferred embodiment, CPU 212 also provides a horizontal synchronization (H Sync) signal, a vertical synchronization (V Sync) signal and window control signals to display 110 via system bus 126. H sync is then provided, via line 312, to HVPS 320 and to window generator 326 via line 328. V sync is provided via line 314 to widow generator 326 and the window control signals are also provided, via line 316, to window generator 326.

The window control signals on line 316 advantageously gate the generation of a high-luminance window on display 110, in accordance with the present invention. In the preferred embodiment, a window request is sent by the host computer operating system 230 or by an application 228 whenever it is desirable to generate a high-luminance window. In another embodiment, the window request may be relayed through a serial communications channel (such as the Video Electronics Standards Association DDC2AB or the Universal Serial Bus) from a host computer 210 to a separately-enclosed display 110. The window request causes CPU 212 to provide the window control signals on line 316. The window control signals then enable window generator 326, which, in turn, initiates the process of generating a high-luminance window on display 110.

The window generator 326 receives the H sync signal on line 312, the V sync signal on line 314 and the window control signals on line 316, and responsively generates and provides a window pulse to ABL 332 via line 330. The generated window pulse provides information about the size and position of window 114 on the viewing screen of CRT 322. Window generator 326 is further discussed below in conjunction with FIG. 5.

ABL 332 receives the window pulse on line 330 and responsively generates and provides an analog window signal (on line 336) to the gain control of video amplifier 318. Analog window signal on line 336 thus increases the luminance of the amplified video signal during the period of window 114 by increasing the gain of video amplifier 318 during the appropriate time period. To prolong the life span of display 110, ABL 332 also advantageously limits the average beam current provided to CRT 322 during the period of high-luminance window 114. In practice, ABL 332 samples HVPS 320 on line 334 and, if HVPS 320 exceeds a preset threshold value, then the gain of video amplifier 318 is limited by adjusting the analog window signal on line 336. The present invention thus provides a video window with a higher luminance level than the remainder of the information displayed on screen 112 of display 110.

Figure 4A:
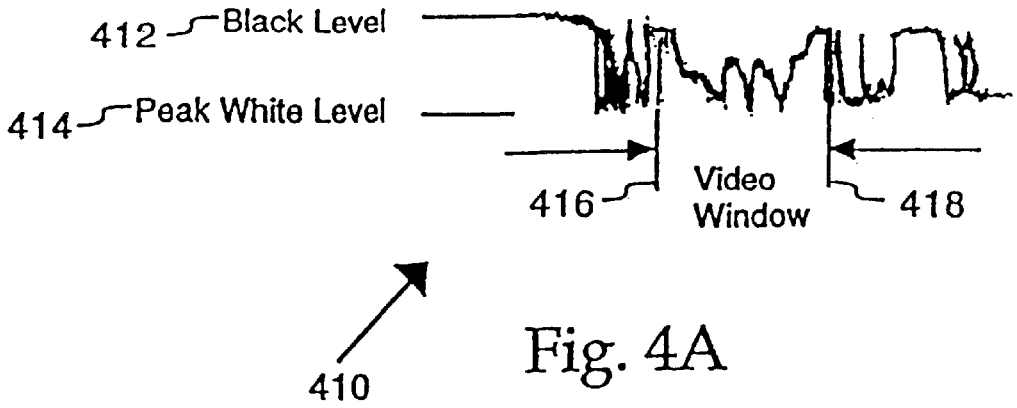
Fig. 4A Prior Art
FIG. 4(*a*) is a drawing of a video waveform illustrating relative video levels including a conventional window area.
Figure 4B:
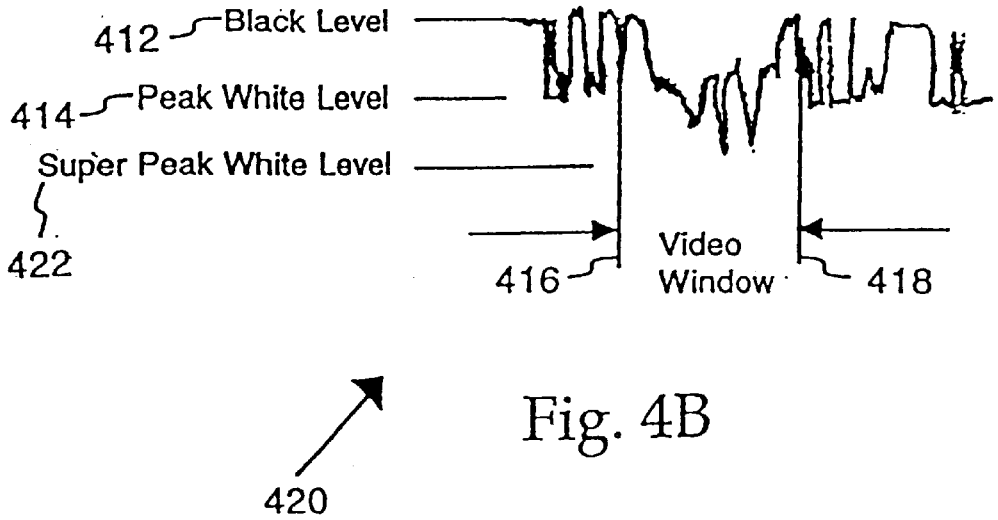

Referring now to FIG. 4A, a drawing of a video waveform 410 including a conventional window area is shown. Referring also to FIG. 4B, a drawing of a video waveform 420 including a high-luminance window area is shown, in accordance with the present invention. In FIG. 4A, the conventional window area is shown on video waveform 410 between times 416 and 418. Waveform 410 also shows a positive-going black level 412 (which represents minimum luminance) and a negative-going peak white level 414 (which represents maximum luminance).

In waveform 420 of FIG. 4B, the high-luminance window area is shown between times 416 and 418. As in FIG. 4A, a positive-going black level 412 and a negative-going peak white level 414 are shown in FIG. 4B. However, in accordance with the present invention, the video waveform 420 also contains video information extending negatively beyond peak white level 414 to reach a super peak white level 422 between times 416 and 418 (in the high-luminance window area). The super peak white level 422 thus represents the area of increased luminance provided in the high-luminance window of the present invention.

Figure 5:
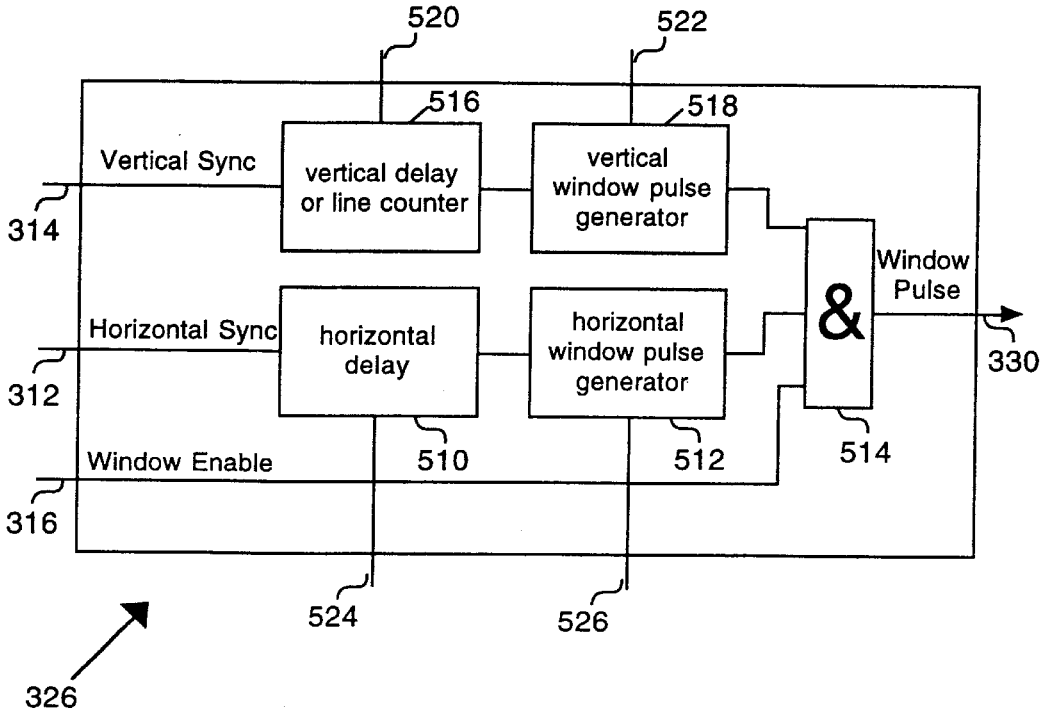
FIG. 5 is a block diagram of the preferred embodiment for the window generator of FIG. 3.

Referring now to FIG. 5, a block diagram of the preferred embodiment for window generator 326 (FIG. 3) is shown. Window generator 326 preferably includes a vertical delay or line counter (vertical delay) 516, a horizontal delay 510, a vertical window pulse generator 518, a horizontal window pulse generator 512 and a three-input AND gate 514.

In practice, window generator 326 uses vertical delay 516 and vertical window pulse generator 518 to provide the vertical position and vertical size of the window area represented by the window pulse on line 330. Furthermore, window generator 326 uses horizontal delay 510 and horizontal window pulse generator 512 to provide the horizontal position and horizontal size of the window area represented by the window pulse on line 330.

In one embodiment, vertical delay 516 receives a control signal 520 from CPU 212 to indicate the vertical starting location of the window area represented by the window pulse on line 330. Vertical window pulse generator 518 then receives a control signal 522 from CPU 212 to indicate the vertical ending location of the window area represented by the window pulse on line 330. Furthermore, horizontal delay 510 receives a control signal 524 from CPU 212 to indicate the horizontal starting location of the window area represented by the window pulse on line 330. Horizontal window pulse generator 512 then receives a control signal 526 from CPU 212 to indicate the horizontal ending location of the window area represented by the window pulse on line 330.

Vertical delay 516 and vertical window pulse generator 518 thus generate a vertical component of the window pulse on line 330 and provide the vertical component to a first input of AND gate 514. Further, horizontal delay 510 and horizontal window pulse generator 512 generate a horizontal component of the window pulse on line 330 and provide the horizontal component to a second input of AND gate 514. A third input of AND gate 514 preferably receives a window enable control signal via line 316. When the window enable signal is held to an "active" or "enabled" state, then window generator 326 advantageously generates the window pulse on line 330, in accordance with the present invention.

Figure 6:
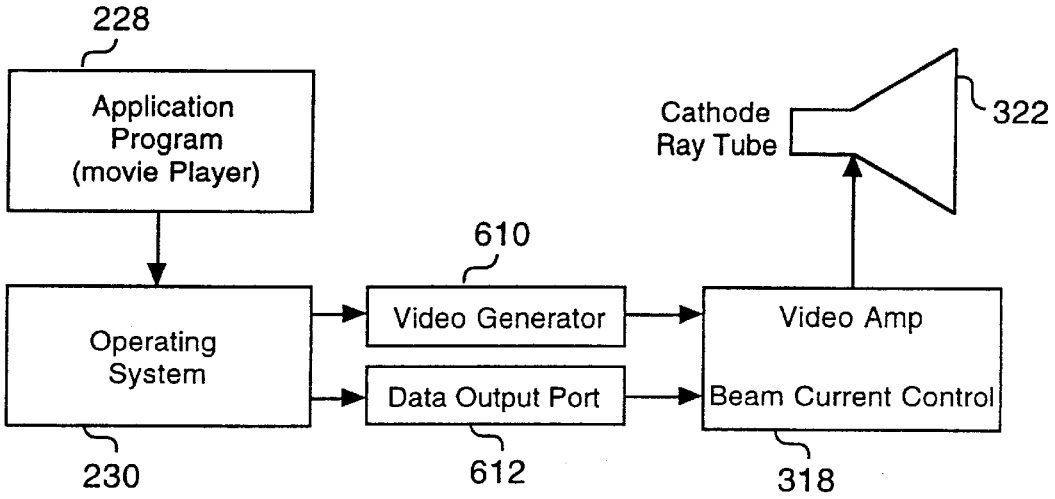
FIG. 6 is a block diagram showing the communication of control information according to the present invention.

Referring now to FIG. 6, a block diagram of one embodiment for the communication path of window control information is shown, in accordance with the present invention. The FIG. 6 communication path preferably includes an application program 228, an operating system 230, a video generator 610, a data output port 612, a video amp 318 and a cathode ray tube (CRT) 322. In this embodiment, the application program 228 is a movie player application which typically sends control signals and video signals to operating system 230. Operating system 230 responsively provides the control signals to data output port 612 and provides the video signals to video generator 610.

Video generator 610 then processes the video signals and provides the processed video signals to video amplifier 318 in display 110. Data output port 612 provides the control signals to the beam current control system of the present invention which advantageously controls the gain of video amplifier 318. CRT 322 then receives the amplified video signals from video amplifier 318, including the high-luminance window area provided in accordance with the present invention.

Figure 7:
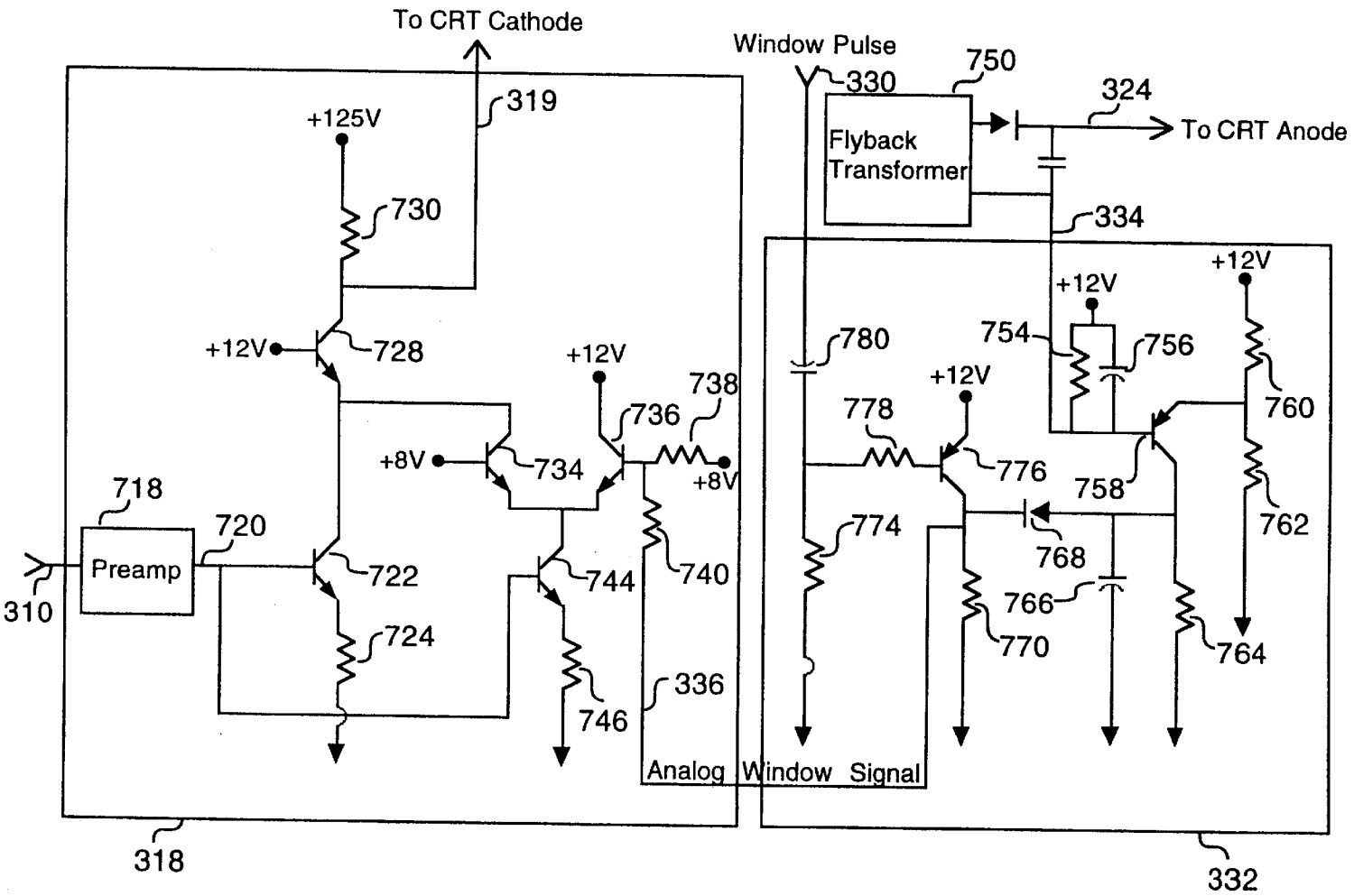
FIG. 7 is a schematic diagram of the preferred embodiment for the video amplifier and automatic beam limiter of FIG. 3.

Referring now to FIG. 7, a schematic diagram of one embodiment for video amplifier 318 and ABL 332 (FIG. 3) is shown. In the FIG. 7 embodiment, preamplifier 718 of video amplifier 318 receives a video signal on line 310 and responsively amplifies and passes the video signal through transistor 722 and transistor 728 to generate and provide an amplified video signal to the cathode of CRT 322 via line 319.

Video amplifier 318 preferably operates in either a normal-gain mode or a high-gain mode. Switching between the normal-gain mode and the high-gain mode is controlled by the state of the analog window signal applied to the gain control of video amplifier 318 via line 336. When the respective bases of transistor 734 and transistor 736 are maintained at the same relative voltage level, then video amplifier 318 operates in normal-gain mode, however, when the analog window signal is applied from ABL 332 to the base of transistor 736, then video amplifier 318 operates in high-gain mode.

To generate the analog window signal on line 336, ABL 332 receives a window pulse on line 330 and responsively passes the window pulse through transistor 776 to line 336. To limit the beam current in CRT 322 during the high-luminance widow, ABL 322 controls the amplitude of the analog window signal on 336. In practice, ABL 332 samples the output current of flyback transformer 750 (of HVPS 320) on line 334 and compares the sampled high-voltage output to a preset threshold. If the threshold is exceeded, then transistor 758 adjusts the output of transistor 776 on line 336 (analog widow signal) to effectively limit the beam current in CRT 322.

Figure 8:
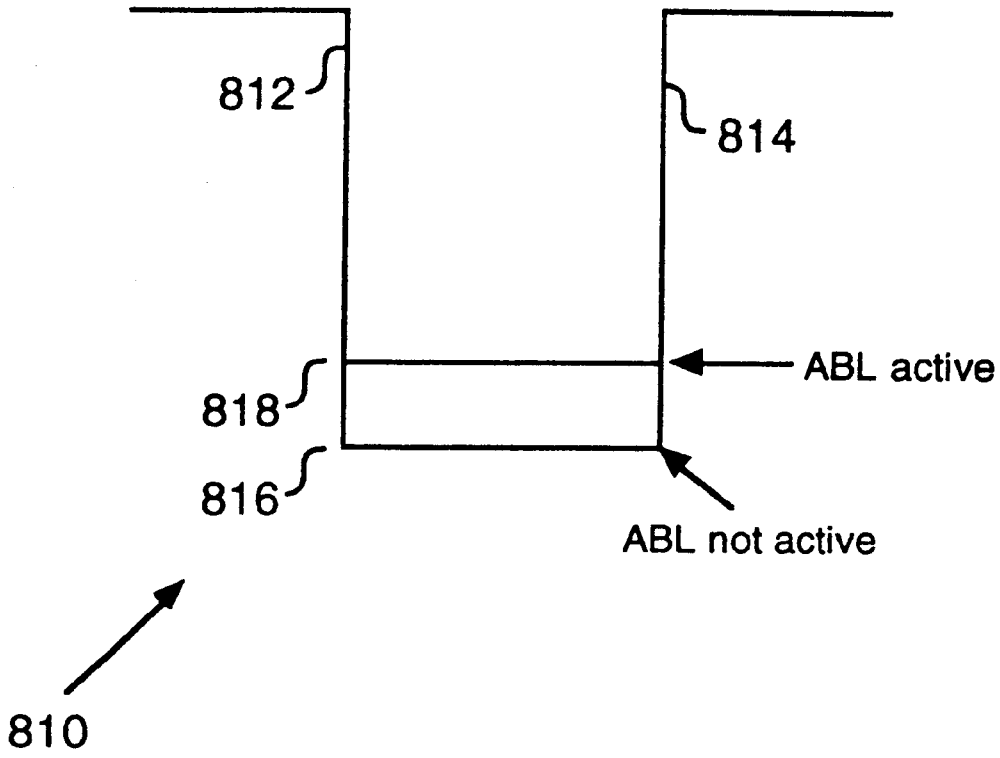
FIG. 8 is a drawing of a waveform for the analog window signal illustrating the effect of automatic beam limiting.

Referring now to FIG. 8, a drawing of an analog window signal waveform 810 is shown, in accordance with the present invention. Waveform 810 shows the analog window signal occurring between times 812 and 814. In the FIG. 8 waveform 810, an amplitude 816 is shown for a state in display 110 where ABL 332 is not actively limiting beam current in CRT 322. Additionally, an reduced amplitude 818 is shown for a state in display 110 where ABL 332 is actively limiting beam current in CRT 322.

Since the high-luminance window may potentially be large (in some cases nearly as large as the entire screen 112 of CRT 110) it is desirable to automatically limit the average beam current by controlling the video signal gain within the high-luminance window. Although peak luminance in the video window can be 3 to 5 or more times the peak luminance of the rest of the display without increasing the power handling capabilities of the chassis, luminance that exceeds these levels can negatively impact CRT phosphor aging. Using ABL 332 to limit beam current during the window period will prevent these undesirably high levels of luminance. Additionally, since ABL 332 only changes the video signal in the window, the system user will have an improved perception of display 110 performance based on smaller spot size and clarity of text/graphics outside the high-luminance window.

The invention has been explained above with reference to a preferred embodiment. Other embodiments will be apparent to those skilled in the art in light of this disclosure. For example, the present invention may readily be implemented using hardware and/or software configurations other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A system for generating a high-luminance viewing window on a display screen, the system comprising:

a video application for displaying a moving video image within said high-luminance viewing window, wherein said video application generates a window request when a moving video image is to be displayed in said high-luminance viewing window;

a means for processing said window request and responsively providing a plurality of window control signals;

a window generator connected to said processing means for receiving said plurality of window control signals, wherein said window control signals include a window enable signal, a vertical start signal and a vertical end signal to provide the vertical position and vertical size of said high-luminance viewing window, and a horizontal start signal and a horizontal end signal to provide the horizontal position and size of said high-luminance viewing window, and wherein said window generator includes an AND gate, wherein said window enable signal is a first input of the AND gate;

a vertical delay for receiving said vertical start signal and a vertical window pulse generator for receiving said vertical end signal, wherein said vertical delay and said vertical window pulse generator provide a vertical component signal to a second input of the AND gate; and a horizontal delay for receiving said horizontal start and a horizontal window pulse generator for receiving said horizontal end signal, wherein said horizontal delay and said horizontal window pulse generator provide a horizontal component signal to a third input of the AND gate, and wherein said AND gate generates a window pulse signal only during the time period said window enable signal, said vertical component signal, and said horizontal component signal indicate said high-luminance viewing window is to be displayed on said display screen;

an automatic beam limiter connected to said window generator for receiving said window pulse signal and responsively generating an analog window signal;

a video amplifier connected to said display screen and to said automatic beam limiter for receiving said analog window signal and a video signal comprised of information to be displayed on said display screen including information to be displayed in said high-luminance viewing window, wherein said video amplifier operates in a normal gain mode when said analog window signal is in a first state and said video amplifier operates in a high gain mode when said analog window signal is in a second state, and wherein said analog window signal is in said second state when said high-luminance viewing window is displayed on said display screen so that said moving video image has a higher luminance level than the remainder of the information displayed on said display screen; and a power supply connected to said automatic beam limiter and to said display screen for providing a beam current to said display screen, wherein said automatic beam limiter limits the luminance level within said high-luminance viewing window by limiting an average beam current provided to said display screen during the time period the high-luminance viewing window is displayed on said display screen.

* * * * *